United States Patent [19]

Liebl

[11] Patent Number: 4,843,239

[45] Date of Patent: Jun. 27, 1989

[54] COMPACT DOUBLE FOCUSSING MASS SPECTROMETER

[75] Inventor: Helmut Liebl, Eching, Fed. Rep. of Germany

[73] Assignee: Max-Planck-Gesellschaft zur Foerderung der Wisserschaften e.V., Eching, Fed. Rep. of Germany

[21] Appl. No.: 51,728

[22] Filed: May 18, 1987

[51] Int. Cl.[4] ..... H01J 49/32

[52] U.S. Cl. ..... 250/296; 250/281; 250/294

[58] Field of Search ..... 250/296, 294, 281, 298

[56] References Cited

U.S. PATENT DOCUMENTS

| | | | |
|---|---|---|---|
| 3,445,650 | 5/1969 | Liebl | 250/296 |
| 3,517,191 | 6/1970 | Liebl | 250/298 |
| 4,171,482 | 10/1979 | Vastel | 250/296 |

*Primary Examiner*—Bruce C. Anderson
*Assistant Examiner*—Jack I. Berman
*Attorney, Agent, or Firm*—Brumbaugh, Graves, Donohue & Raymond

[57] ABSTRACT

A compact double-focussing mass spectrometer comprises, in the order named along an ion beam path, an einzel lens for focussing ions entering through an entrance slit into an exit slit and for effecting angle focussing, further a magnetic deflection field and an electric sector field each having a deflection angle of 30 degrees and opposite directions of deflection and in combination effecting energy focussing. Since the deflection angles of the magnetic and electric fields are relatively small and have opposite directions, the net ion beam path is essentially straight, and therefore the mass spectrometer can be implemented by a compact structure.

9 Claims, 6 Drawing Sheets

Focal length $f = \frac{r}{\sin\Phi}$

Dispersion factor $\nu = \frac{1}{2}\sin\Phi$; $\delta = \frac{\Delta U}{U}$; $\gamma = \frac{\Delta M}{M}$ Exit equation $Y = L'\alpha + X\left[\left(1 - \frac{L'}{f}\right)\alpha + \nu(\delta+\gamma)\right]$ <u>Uniform magnetic sector field</u>

Focal length $f_e = \frac{r_e}{\sqrt{2}\sin\sqrt{2}\,\phi_e}$ $p = \frac{r_e}{\sqrt{2}}\tan\frac{\phi_e}{\sqrt{2}}$ Dispersion factor $\lambda = \frac{1}{\sqrt{2}}\sin\sqrt{2}\,\phi_e$ ; $\delta = \frac{\Delta U}{U}$ Exit equation $Y_e = L'_e\alpha_e + X_e\left[\left(1-\frac{L'_e}{f_e}\right)\alpha_e + \lambda\delta\right]$ <u>Electric sector field (cylindrical condenser)</u>

Energy focus at $L''_e = \dfrac{D}{D/f_e - \lambda/\nu - 1}$

Mass dispersion $Y_e(\gamma) = -\left[D + L''_e\left(1 - \dfrac{D}{f_e}\right)\right]\nu\gamma$ Energy focusing Imaging ratio $$\frac{s''}{s'} = \left\{a\left[\left(1-\frac{e}{f_1}\right)\left(\frac{D}{ff_e}-\frac{1}{f}-\frac{1}{f_e}\right)-\frac{1}{f_1}\left(1-\frac{D}{f_e}\right)\right]+e\left(\frac{D}{ff_e}-\frac{1}{f}-\frac{1}{f_e}\right)+1-\frac{D}{f_e}\right\}^{-1}$$

Angle focusing

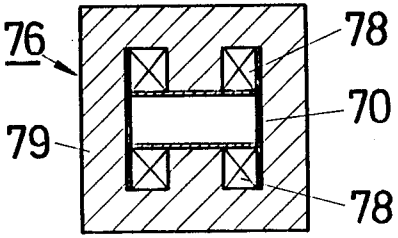
Fig. 6C
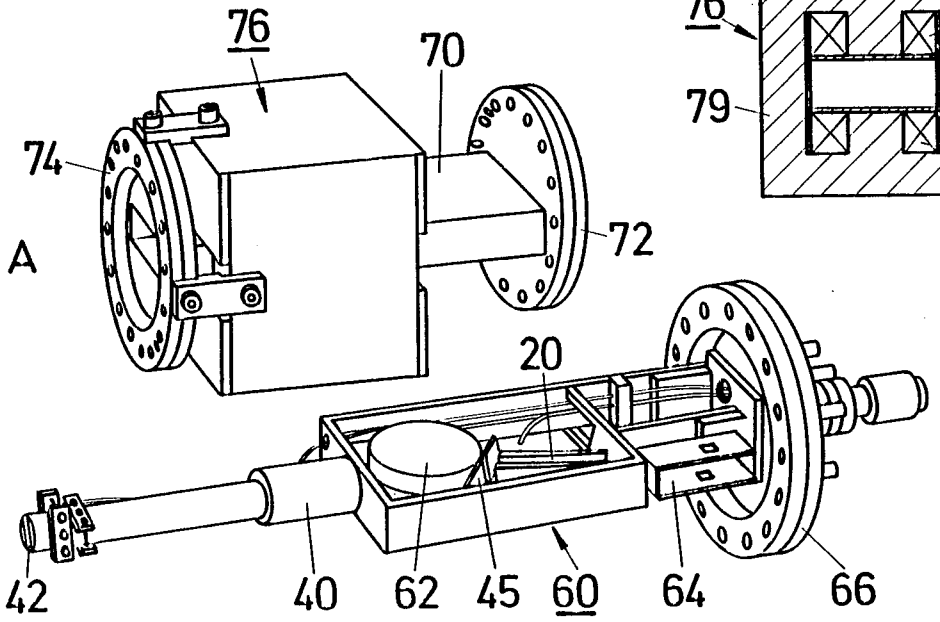
Fig. 6A
Fig. 6B

COMPACT DOUBLE FOCUSSING MASS SPECTROMETER

The present invention relates to mass spectrometers, i.e. devices for determining the charge to mass ratio of electrically charged particles, i.e. ions. More specifically, the invention relates to a compact, space-saving double-focussing mass spectrometer with angle and energy focussing.

BACKGROUND OF THE INVENTION

Double-focussing mass spectrometers which provide for angle and energy focussing are well known in the art. Such mass spectrometers may comprise electric and magnetic fields in tandem which are dimensioned so that the desired focussing conditions are obtained. However, the known double-focussing mass spectrometers use magnetic and electric deflection fields with relatively large deflection angles which result in a bent ion beam path between an entrance slit through which the ions to be analysed enter and an exit slit, through which ions with a selected charge/mass ratio pass to an ion detector. This makes the implementation by a compact and space-saving structure difficult.

BRIEF DESCRIPTION OF THE INVENTION

It is an object of the present invention to provide a compact mass spectrometer which is comparable in size to a quadrupole mass spectrometer so that it can be conveniently attached to an existing port of a conventional ultrahigh vacuum (UHV) system.

A further object of the invention is to provide a double-focussing (energy and angle focussing) mass spectrometer which is able to cope with ions having a quite broad energy distribution, as sputtered ions in a secondary ion mass spectrometery (SIMS) system.

Still a further object of the invention is to provide a double-focussing mass spectrometer having an acceptance (defined as entrance slit area times solid angle within which the ions are accepted) as well as an acceptable ion energy range larger than those of known double-focussing mass spectrometers of a comparable size.

These and other objects are obtained, according to the invention, by a mass spectrometer, which comprises, in the order named along an ion beam path between an entrance aperture and an exit aperture, an einzel lens for focussing ions entering through the entrance aperture into the exit aperture, and for assisting the desired angle focussing, and further a magnetic deflection field and an electric sector deflection field which have a deflection angle less than about 45 degrees, preferably about 30 degrees each and opposite directions of deflection and, in combination, effecting the desired energy focussing.

Since the deflection angles of the magnetic and electric fields, are relatively small and have opposite directions, the net ion beam path is essentially straight and therefore the mass spectrometer can be implemented by a compact structure.

BRIEF DESCRIPTION OF THE DRAWINGS

Further objects, features and advantages of the invention will become apparent to those skilled in the art when reading the following description of a preferred embodiment thereof with reference to the accompanying drawings, in which

FIGS. 6A and 6B are perspective views of a housing and magnet structure portion, and of an electrode system portion of a preferred embodiment of the present invention;

FIG. 6C a cross-section of the magnet structure of FIG. 6A;

MAGNETIC SECTOR FIELD

Figure 1:
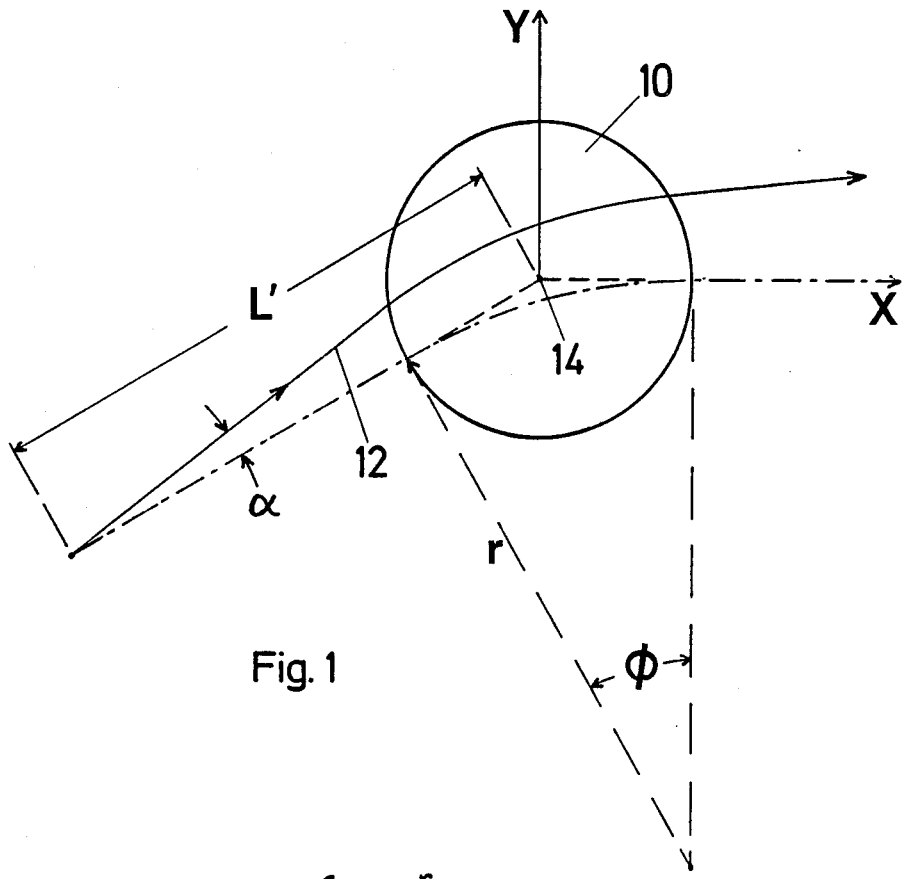
FIG. 1 shows a digrammatic depiction of a uniform magnetic sector field having an essentially circular cross-section, and equations for essential properties of such a field.

For a uniform magnetic sector field 10 with boundaries normal to the beam axis (FIG. 1), the equation of an ion trajectory 12 after passage through the field is (in first approximation)

$$Y = L'\alpha + X\left[\left(1 - \frac{L'}{f}\right)\alpha + \nu(\delta + \gamma)\right], \tag{1}$$

wherein

L' is the object distance from the deflection centre 14, is the entrance angle, $f = r/\sin\phi$ the focal length of the sector field wherein $\phi$ is the deflection angle, $\nu = \sin\phi/2$ the dispersion factor, $\delta = \Delta U/U$ the relative energy spread of the ions, and $\gamma = \Delta M/M$ the relative mass difference (ions with energy U and mass M having the deflection radius r).

Electric sector field

Figure 2:
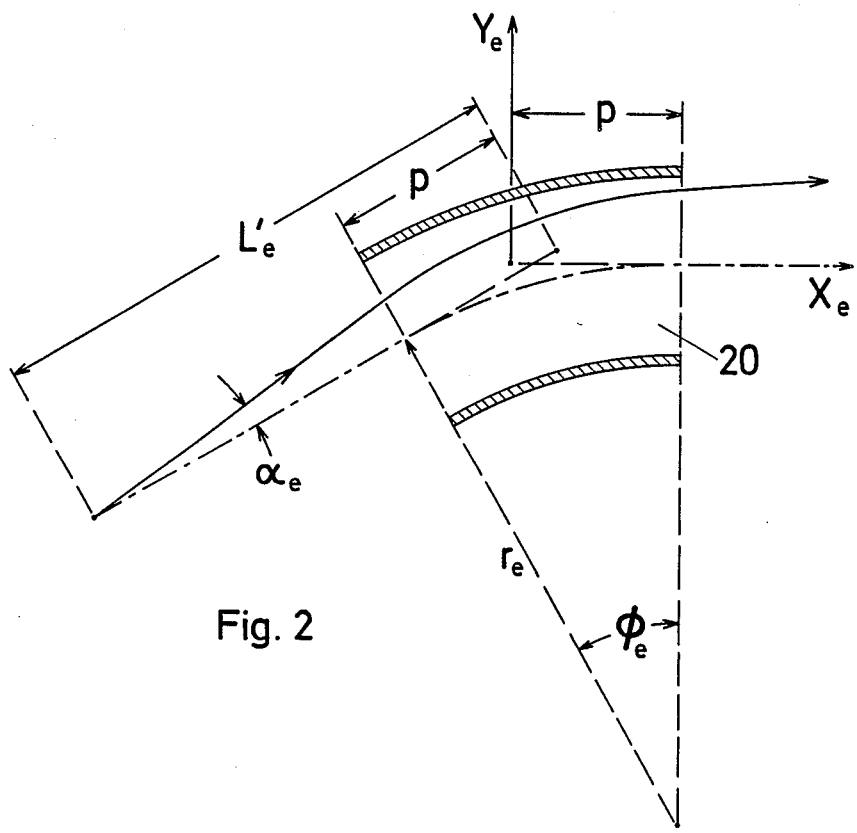
FIG. 2 shows a schematic depiction of an electric sector field (cylindrical condensor) and of equations for essential features of such a field.

Analogously, for an electric sector field 20 (FIG. 2), produced between a pair of concentrically curved plates of a cylinder condenser, the exit equation is $$Y_e = L'_e\alpha_e + X_e\left[\left(1 - \frac{L'_e}{f_e}\right)\alpha_e + \lambda\delta\right], \tag{2}$$

wherein $L'_e$ is the object distance from the entrance side principal plane, $\alpha_e$ the entrance angle, $f_e = r_e/\sqrt{2}\sin\sqrt{2}$, $\phi_e$ the focal length of the cylindrical sector field, and $\lambda = \sin(\sqrt{2}\phi_e)/\sqrt{2}$ its dispersion factor.

Here, only energy dispersion is exerted but no mass dispersion. There are two principal planes at the distance $p=r_e \tan(\phi_e/\sqrt{2})/\sqrt{2}$ from the field boundaries.

Energy focussing

Figure 3:
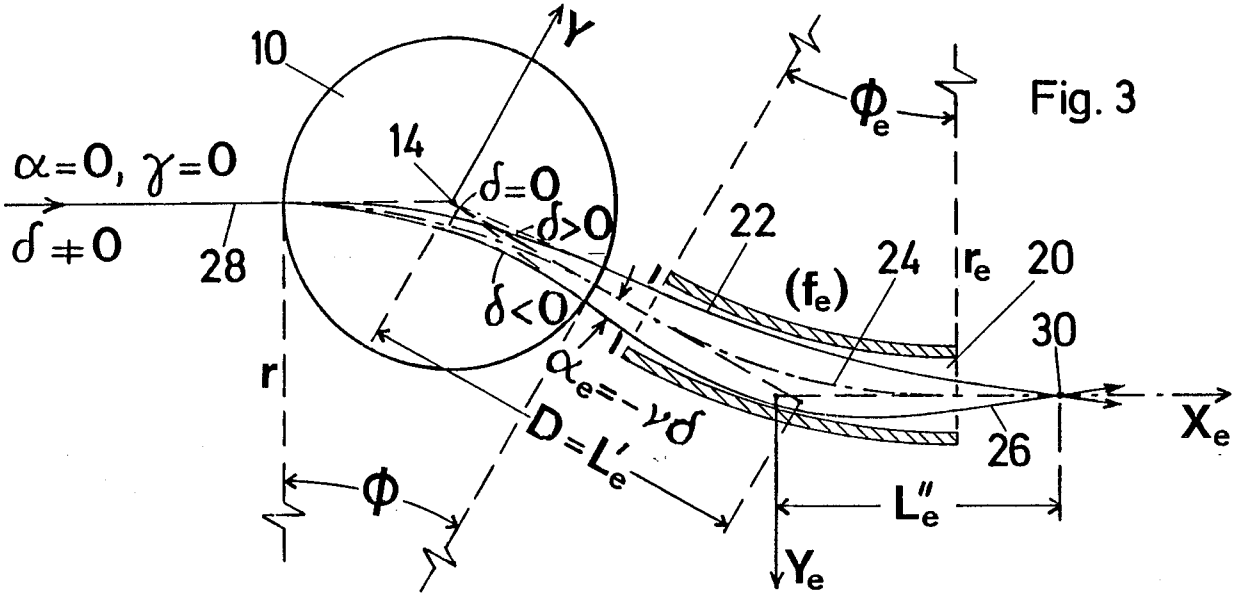
FIG. 3 shows a tandem arrangement of a magnetic deflection field and of an electric deflection field having equal angles of deflection and opposite directions of deflection, and equations for the energy focussing condition and the mass dispersion of such a combination.

For achieving a compact geometry, a solution without an intermediate image of the entrance aperture was chosen, resulting in opposite deflection (FIG. 3). In order to find the condition for energy focussing, trajectories 22, 24, 26 considered of ions of mass M ($\gamma=0$) entering the magnetic field 10 on axis 28 ($\alpha=0$) with a certain energy deviation $\delta$. The energy dispersion of the magnetic field causes that the ions enter into the electric field 20 with an entrance angle $\alpha_e=-\nu\delta$, the object point being deflection centre 14 of the magnetic field 10 at the distance D from the exit side principal plane thereof. By inserting $L'_e=D$ and $\alpha_e=-\nu\delta$ in eq. (2), the distance $X_e=L''_e$ is found where the trajectories cross the exit abscissa ($Y_e=0$):

$$L''_e = \frac{D}{D/f_e + \lambda/\nu - 1}. \tag{3}$$

The parameters were chosen such that the whole electrode assembly would fit into a straight rectangular tube welded between 51.2 cm (6 inch) o.d. conflat flanges and forming a vacuum-tight envelope:

$$r=r_e=12\text{ cm},\ \phi=\phi_e=30°,\ D=7,1\text{ cm}.$$

This choice results in $f=24$ cm, $f_e=12{,}6$ cm, $\nu=0{,}25$, $\lambda=0{,}48$, and from eq. (3) $L''_e=4{,}8$ cm.

This means that the energy focus 30 is located close (1,5 cm) behind the electric field exit boundary. There an exit aperture, as an exit slit is placed (not shown).

Angle focussing

Figure 4:
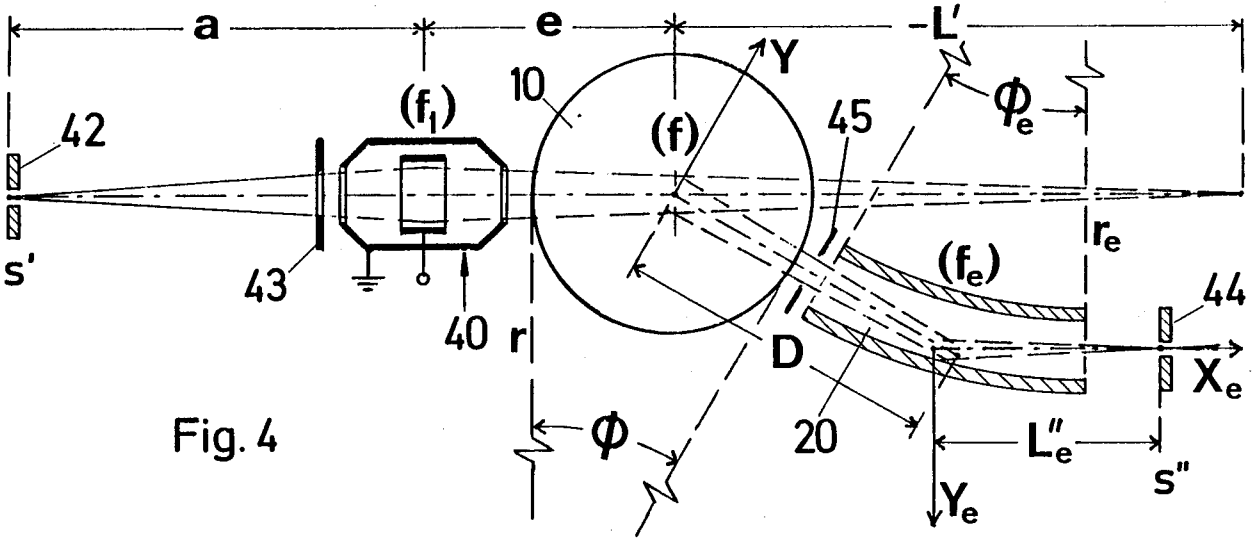
FIG. 4 is a schematic diagram of the electrode system of a preferred embodiment of a double focussing mass spectrometer according to the present invention.

In order to obtain double-focussing, the angle focus, i.e. the image of the entrance aperture, as an entrance slit (not shown), must coincide with the energy focus. The calculation yields a negative object distance L' (=−39 cm) for the system of FIG. 3 with the above parameters. This means that the lens action of the two sector fields is too weak to form at the location of the exit slit, a real image of an entrance slit situated anywhere in front of the magnetic field. As shown in FIG. 4, an einzel lens 40 is therefore placed in front of the magnetic field 10, which can be tuned to image the entrance slit 42 on the exit slit 44. In the direction normal to the deflection plane (paper plane in FIG. 4), the einzel lens 40 focuses the beam also, so that no loss due to cutoff occurs in that direction between the einzel lens and an detector (not shown in FIG. 4) placed behind the exit slit 44.

Mass resolution

The mass dispersion at the exit slit 44 is obtained by introducing into eq. (2) $L'_e=D$, $\alpha_e=-\nu\gamma$, $X_e=L''$, $\delta=0$;

$$Y_e(\gamma) = -\left[D + L''_e\left(1 - \frac{D}{f_e}\right)\right]\nu\gamma = -2.3\gamma(\text{cm}). \tag{4}$$

The imaging ratio from the entrance to the exit slit is found by the transfer matrix method to be $$\frac{s''}{s'} = \left\{a\left[\left(1-\frac{e}{f_1}\right)\left(\frac{D}{ff_e}-\frac{1}{f}-\frac{1}{f_e}\right)-\frac{1}{f_1}\left(1-\frac{D}{f_e}\right)\right]+e\left(\frac{D}{ff_e}-\frac{1}{f}-\frac{1}{f_e}\right)+1-\frac{D}{f_e}\right\}^{-1}. \tag{5}$$

By equating the mass dispersion, eq. (4), with the image width, s'', from eq. (5) one obtains the theoretical mass resolution $(M/\Delta M)_{th}=1/\gamma$.

Technical details

In a preferred practical embodiment shown in FIGS. 6A, B and C, the whole mass spectrometer assembly 60 (FIG. 6B), comprising, in the order named along an ion beam path, an entrance slit 42 positioned in an entrance aperture plane, two pairs of electrostatic beam adjustment plates (not shown) for adjusting the position of the ion beam entering the einzel lens, an aperture stop diaphragm 43 (see FIG. 4), the einzel lens 40, a pair of pole pieces 62 between which the magnetic field 10 is produced, another aperture stop diaphragm 45, the cylindrical condensor 20, the exit slit 44 positioned in an exit aperture plane, and a channeltron ion detector 64, is mounted in a cantilever fashion on a 15.2 cm (6 inch) o.d. conflat flange 66. The flange comprises all electrical feedthrough conductors, so that all connections can be made on a bench outside the vacuum system. The assembly 60 slides into a UHV housing 70 (FIG. 6A) consisting of a straight rectangular tube with inner dimensions $3\times10$ cm$^2$, welded between a pair of 15.2 cm o.d. conflat flanges 72, 74. An electromagnet system 76 comprising copper coils 78 and a core 79 with yokes is attached to the one 74 of the conflat flanges and has the shape of a block with edge dimensions of $13\times15\times15$ cm$^3$. The electromagnet system is capable of generating a field with a strength up to 10,000 gauss inside the gap between the pole pieces, when the coils are energized with a power of 450 W. This corresponds to a minimum product of mass and voltage of nearly $7\times10^5$ amu (atomic mass units)$\times$volt, i.e. at an ion acceleration voltage of 1000 V, the mass range is up to 700. For prolonged operation in a high power range, water cooled plates may be attached to the magnet system. Owing to the compact shielded construction, the stray field outside the magnet block is very low; it is less than $10^{-3}$ of the field strength in the gap. The vacuum housing has a pocket (not shown) reaching into the magnet gap, so that the field may be monitored or controlled with a Hall probe.

Figure 5:
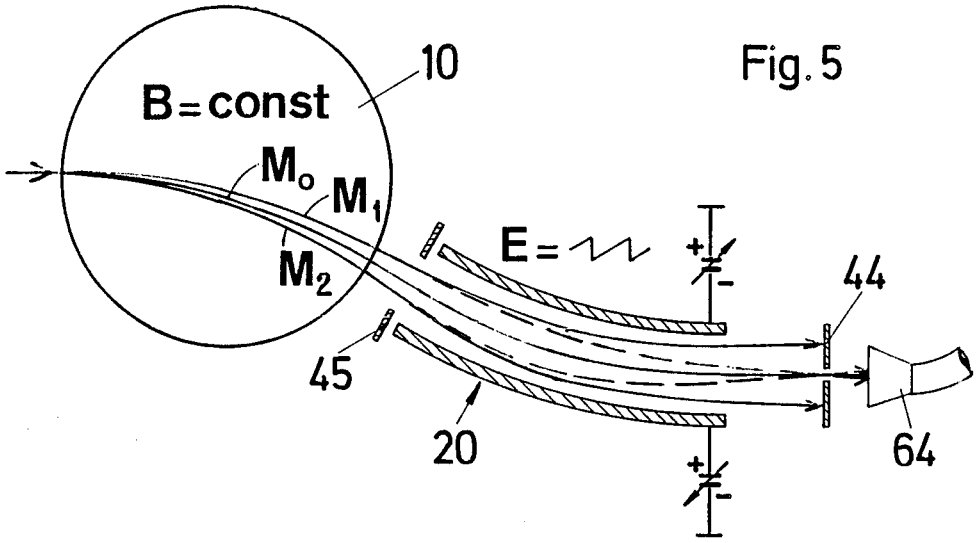
FIG. 5 is a schematic view of a part of the electrode system of FIG. 4 for explaining a scanning mode of operation of the system of FIG. 4.

Voltages of opposite polarity which are symmetrical with respect to ground and have a magnitude of about 1/15 of the acceleration voltage, are applied to the plates of the condensor for producing the electrical deflection field 20, as schematically shown in FIG. 5.

In the assembled and operative state, the flange 72 is attached to the flange 66, the assembly 60 is within the housing 70, and the flange 74 is attached to an appropriately flange port of a vacuum system (not shown).

Referring again to FIG. 4, the center-to-center distance e from the einzel lens to the magnet is 6 cm. The distance a of the entrance slit 42 from the einzel lens was chosen as 14 cm. With these values, the focal length of the einzel lens, $f_1$, must be 10.7 cm for imaging the entrance slit 42 on the exit slit 44. The imaging ratio, eq. (5), is then 0.76, i.e. slight demagnification occurs. The einzel lens was operated in the accel-decel mode in order to keep the spherical and chromatic aberrations sufficiently low. For $a=14$ cm, $f_1=10.7$ cm a voltage ratio of 1.85 is required with the present construction, i.e. with the ion source at +2 kV the lens voltage is −1.7 kV.

The entrance slit heigth is 2 mm, the exit slit height being larger than the beam height there, so that no part of a beam with a certain limited energy spread filling the entrance slit area and passing the 4 mm dimeter einzel lens aperture is cut off. For the test measurements the entrance and exit slits were both adjusted to a width of 50 μm. With this value comparison of eqs. (4) and (5) predicts a mass resolution of 250.

Figure 7:
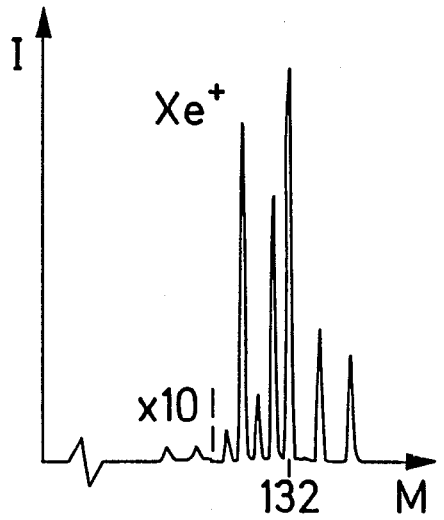
FIG. 7 shows a typical example of a mass spectrum obtained with the mass spectrometer of FIGS. 6A and 6B.

The mass spectrometer was tested using a beam of 2 keV $Xe^+$ ions from a unoplasmatron gun with a hollow cathode. FIG. 7 shows the $Xe^+$ spectrum as recorded by ramping the magnetic field. The isotopes are completely resolved, the FWHM resolution is about 260. The energy spread ΔU of the ions from the plasma source is estimated to be about 4 eV, so that $\delta=2\times10^{-3}$.

One advantage of the field sequence chosen is that for a limited relative mass range electric peak switching with the electric sector field is possible (FIG. 5). The electric field gap, i.e. the distance between the plates of the cylindrical condensor, is wide enough to accomodate ions leaving the magnetic field that cover a relative mass range of $(\Delta M/M)=0{,}2$. Most of the elemental isotopes can therefore be scanned or switched with constant magnetic field by ramping or stepping the deflection voltage of the cylindrical condenser.

In the above described embodiment a single mass line is selected by a single exit slit. However, one or more additional exit slits, each with an associated ion detector, may be provided in the image plane of the einzel lens, where images of the entrance slit are formed by the separated beams comprising ions of different charge/mass ratio. This allows simultaneous or parallel detecting and monitoring of different mass lines.

At an FWHM resolution of 260 the compact mass spectrometer transmits ions filling an entrance slit 0.1 $mm^2$ in area and solid angle of $6.4\times10^{-4}$ sr and having a relative energy spread of 1%, the maximum product of mass and energy is $7\times20^5$ amu×volt. with a nominal ion energy of 2 keV and an energy spread of 20 eV the mass range is therefore up to a mass number of 350. Fast electric peak switching is possible within a relative mass range of 20%.

The deflection angle of the magnetic and electric fields is chosen to be a compromise between high resolution which commands a large deflection angle, and compact overall configuration, which calls for small deflection angles. Deflection angles less than 45 degrees are satisfactory, 30 degrees are preferred.

While a specific, preferred embodiment of the invention has been described, various modifications and alterations will occur to those skilled in the art without having the scope of the appended claims.

A multiple detector, comprising e.g. a channel plate multiplier, may be used instead of an multiple exit slit arrangement.

I claim:

1. A double-focussing mass spectrometer system comprising in the order named along an ion beam path between entrance and exit aperture planes an einzel lens, first means for producing a magnetic field to cause a predetermined first nominal angle of deflection of the ion beam in a predetermined direction, second means for producing an electrical deflection field to cause a predetermined second nominal angle of deflection of the ion beam in a direction opposite to said predetermined direction, said einzel lens imaging said entrance aperture plane onto said exit aperture plane, and said magnetic and electric fields being chosen to effect energy focussing of said ions at said exit aperture plane, said first and second nominal angles of deflection being each less than 45 degrees.

2. The system as claimed in claim 1, further comprising a slit-shaped entrance diaphragm positioned in said entrance aperture plan, and at least one slit-shaped exit diaphragm positioned in said exit aperture plane.

3. The system as claimed in claim 1, wherein said first and second nominal angles of deflection are each about 30 degrees.

4. The system as claimed in claim 1, wherein an arrangement comprising said einzel lens, said first and second means, entrance and exit slit diaphragms positioned in said entrance and exit aperture planes, respectively, and an ion detector positioned along said ion beam path after said exit slit diaphragm is mounted in a cantilever fashion on a first vacuum flange member.

5. The system as claimed in claim 4, further characterized by a pair of second and third vacuum flange members and a tubular housing having its ends connected to said pair of flanges, and a magnet system surrounding said housing, said housing fitting around said arrangement with said first and second flanges connected to each other and said third flange being chosen for connection to a flanged port of a vacuum system.

6. A double-focussing mass spectrometer system comprising in the order named along an ion beam path between entrance and exit aperture planes an einzel lens, first means for producing a magnetic field to cause a predetermined first nominal angle of deflection of the ion beam in a predetermined direction, second means for producing an electrical deflection field to cause a predetermined second nominal angle of deflection of the ion beam in a direction opposite to said predetermined direction, said einzel lens imaging said entrance aperture plane onto said exit aperture plane, and said magnetic and electric fields being chosen to effect energy focussing of said ions at said exit aperture plane, said einzel lens, said first and second means, entrance and exit slit diaphragms positioned in said entrance and exit aperture planes, respectively, and an ion detector positioned along said ion beam path after said exit slit diaphragm forming an arrangement, which is mounted in a cantilever fashion on a first vacuum flange member.

7. The system as claimed in claim 6, further characterized by a pair of second and third vacuum flange members and a tubular housing having its end connected to said pair of flanges, and a magnet system surrounding said housing, said housing fitting around said arrangement with said first and second flanges connected to each other and said third flange being chosen for connection to a flanged port of a vacuum system.

8. The system as claimed in claim 6, wherein said first and second nominal angles of deflection are each less than 45 degrees.

9. The system as claimed in claim 6, wherein said first and second nominal angles of deflection are each about 30 degrees.

* * * * *